US005301619A

United States Patent [19]

Keersmaekers

[11] Patent Number: 5,301,619

[45] Date of Patent: Apr. 12, 1994

[54] INSTALLATION FOR THE INCINERATION OF WASTE

[76] Inventor: Marc Keersmaekers, Kesselsteenweg 12, 2560 Nijlen, Belgium

[21] Appl. No.: 981,730

[22] Filed: Nov. 25, 1992

[30] Foreign Application Priority Data

Nov. 27, 1991 [BE] Belgium ..... 9101094

[51] Int. Cl.[5] ..... F23G 5/00

[52] U.S. Cl. ..... 110/246; 110/226; 432/113; 432/116

[58] Field of Search ..... 110/246, 226; 432/116, 432/113, 103

[56] References Cited

U.S. PATENT DOCUMENTS 2,274,780 3/1942 Duerr et al. ..... 110/246 X
4,266,931 5/1981 Struckmann ..... 110/246 X
5,103,745 4/1992 Harloff ..... 110/246

FOREIGN PATENT DOCUMENTS 44191 6/1931 Denmark ..... 110/246

*Primary Examiner*—Edward G. Favors
*Attorney, Agent, or Firm*—William A. Drucker

[57] ABSTRACT

The drum of the installation is provided with a double wall which is closed on its rear end and where the inside wall of which is provided with openings, with a hollow central tube provided with openings the rear end of which tube is closed, and with radial double walls provided with openings and which connect said tube and the double drum wall with one another, where a duct is provided for blowing incineration air directly into the drum and a duct for at least partially recycling the burnt combustion gases from the drum and returning them to the drum, for cooling the double drum wall, controlling the furnace temperature and preventing waste from baking onto the drum.

6 Claims, 3 Drawing Sheets

Fig. 3
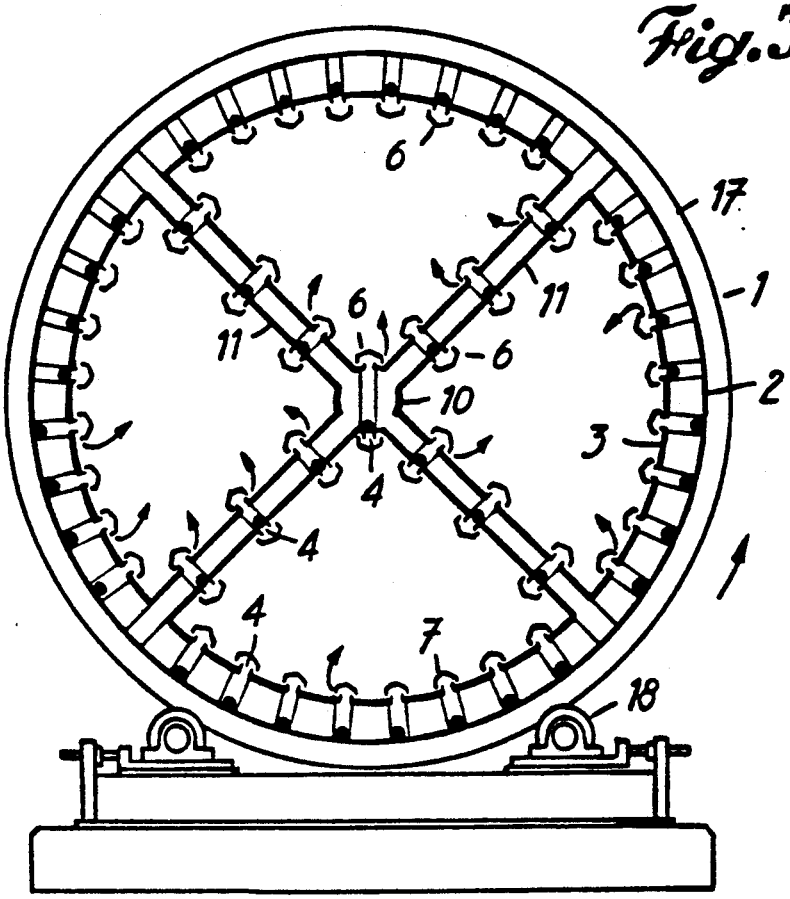
Fig. 4
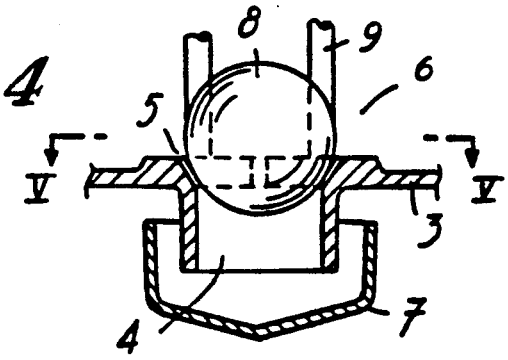
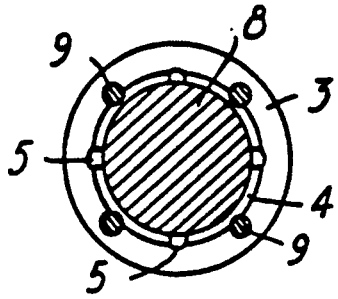
Fig. 5

INSTALLATION FOR THE INCINERATION OF WASTE

The invention relates to an installation with a rotating incineration drum with which it is possible adequately to incinerate all kinds of waste such as household waste, hospital waste and chemical waste.

An installation is known for the incineration of waste which comprises a single incineration drum, a means to rotate the drum about its axis, means for guiding the drum during its rotational motion and a burner for heating the incineration air and the combustion gases rising from the waste.

Such a device nevertheless suffers from the disadvantage that in order to prevent the overloading of the drum with waste and to obtain good incineration of the waste, the capacity of the installation is limited. Moreover it appears that the installation is more suitable for incinerating sludge and pasty wastes and less suitable for the incineration of household waste.

In order to correct these disadvantages and according to the principal characteristic of the invention an installation has been realized according to which the drum is provided with a double wall which is shut on its rear side, the inside wall of which is provided with openings, which drum is provided with a hollow central tube provided with openings where the rear end of which tube is closed, and is provided with radial double walls provided with openings and which connect said tube and double drum wall with one another, where a duct is provided for blowing incineration air directly into the drum and a duct for at least partially recycling the burnt combustion gases from the drum and returning them to the drum, for cooling the double drum wall and preventing waste from baking onto the drum.

The radial double walls of the drum ensure good mixing of the waste in the drum, so that adequate incineration of the waste becomes possible and also that the added combustion air, the combustion gases rising from the waste and the recycled flue gases are sufficiently mixed by turbulence, so that good combustion of the gases is obtained as well.

Also the special layout of the drum considerably enlarges the useful incineration surface, so that the thickness of the layer of the waste can be reduced, so that it can be dried and incinerated better than before. Also in this drum the waste is not rolled up during the rotating motion of the drum but good distribution of the waste in the drum is achieved.

Another advantage of the installation according to the invention is that the incineration space in the drum can be kept extremely compact, so that this space can be heated relatively quickly, something which is important when starting up and stopping waste incineration.

A further advantage is that the partial recycling of the extracted combustion gases means that a smaller combustion gas fan, stack and associated ducts can be used, and that as a result the CO content of the gases, energy consumption and costs of the incinerator installation can be kept low. Other favourable effects of the recycling of the combustion gases and the direct supply of incineration air are that these are used as a cooling agent for cooling the double wall of the drum, that the temperature in the furnace space of the drum is controlled and that the guaranteed quantity of waste can be incinerated and it is possible to provide the external walls of the installation merely with an insulating layer instead of building these in refractory brick.

As the incineration air and the recycled combustion gases are directly blown into the fire, good control of the temperature in the drum and good post-incineration of the waste is possible, so that all kinds of waste can be incinerated.

A further advantage is that the drum can be composed of several parts, so that the length of the drum can be adjusted in accordance with the intended purpose.

By way of example, and without in any way being exhaustive, a more complete description of a preferred embodiment of the installation in accordance with the invention is given below. This description refers to the attached drawings, where:

FIG. 3 shows an enlarged cross-section of the drum along the line III—III in FIG. 2;

FIG. 4 shows an enlarged vertical lengthways section of a valve of the drum;

FIG. 5 shows a horizontal cross-section of a valve along the line V—V in FIG. 4.

Figure 1:
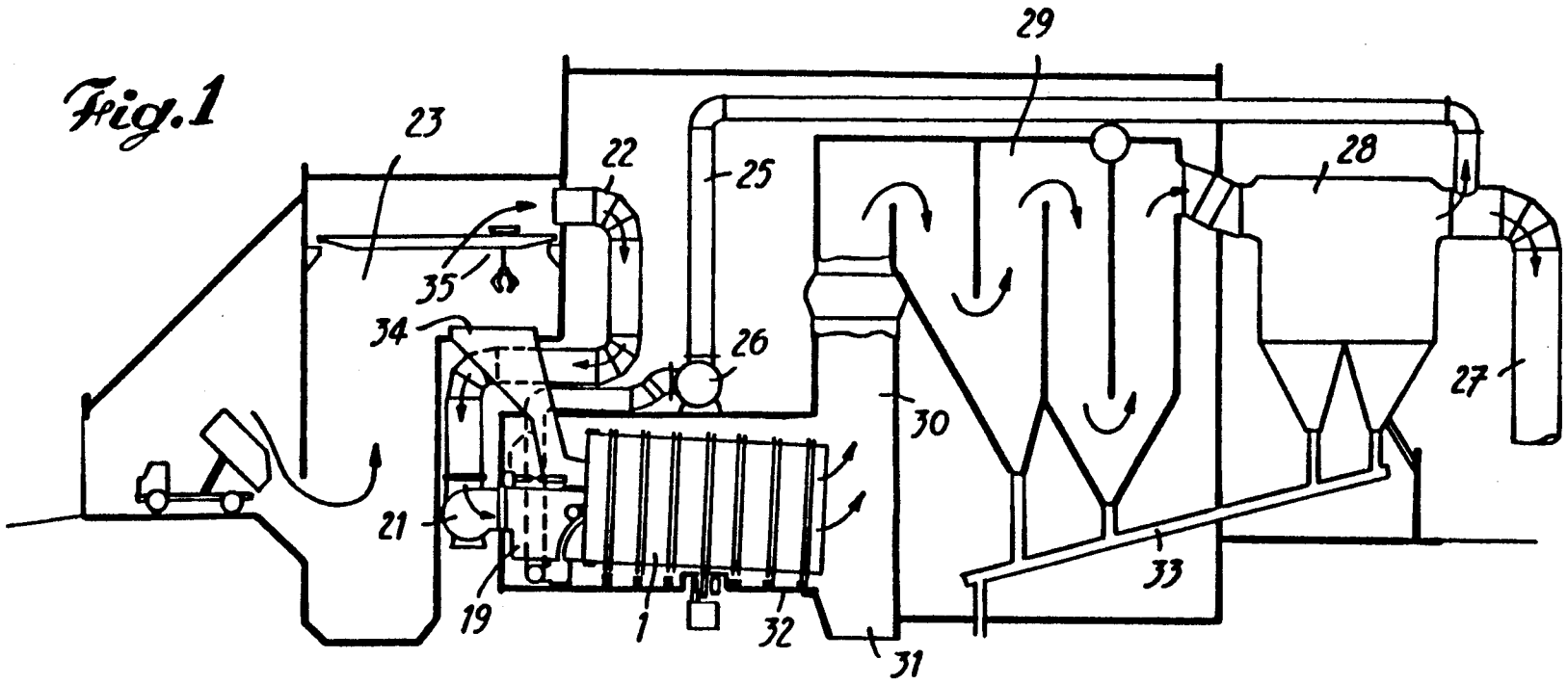
FIG. 1 shows a vertical lengthways section of a complete incinerator installation.
Figure 2:
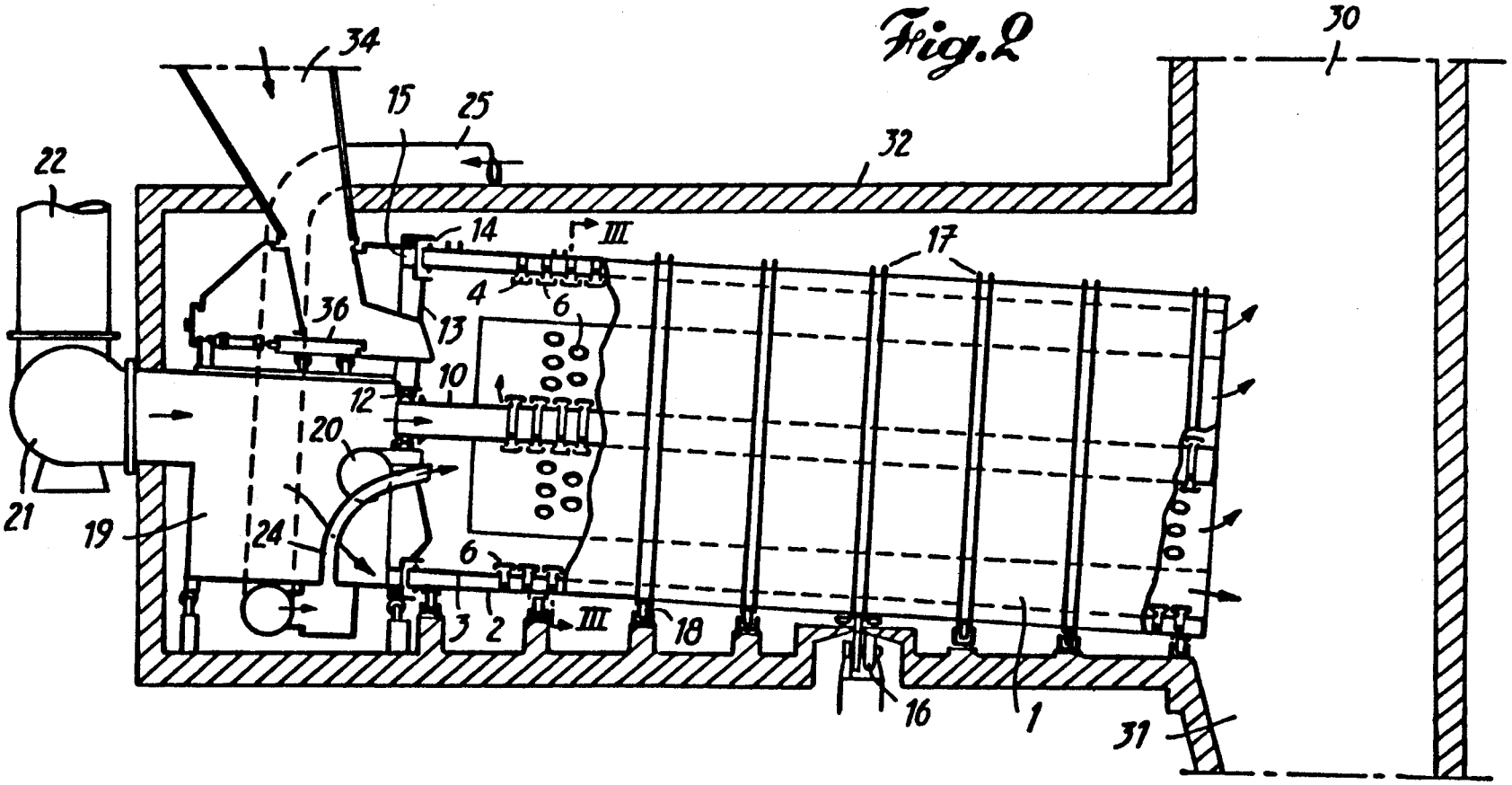
FIG. 2 shows a part enlargement of a vertical lengthways section of the drum with surrounding parts.

In these figures a drum 1 sloping downwards to the rear can be seen with open ends for the incineration of waste. This drum has a double wall 2–3 which is open at the front end and closed at the back end, the inner wall 3 of which is provided over the greater part of its surface with openings 4 with four radial grooves 5 and in which a valve 6 is mounted. Each valve has a protective cover 7 installed over the opening 4 in order to prevent waste sticking in the opening and a spherical closer 8 which can move up and down between four guide rods 9 and which is capable of closing the opening 4 with the exception of the four radial grooves 5. This arrangement makes it possible for a small quantity of combustion air to escape via the seating of the valve. Installed centrally in the drum 1 is a hollow tube 10 which is likewise provided with openings 4 in which a valve 6 as described above is mounted. The rear end of this tube 10 is closed. Between tube 10 and the inner wall 3 of the drum 1, there are four radially installed double walls 11 provided which connect the tube with the spaces between the double walls 2–3. The radial walls are likewise provided with openings 4 and valves 6 over their entire surface as described above. The foremost open end of the tube 10 is mounted in a roller bearing 12 mounted in a fixed wall 13. The open front end of the double wall 2–3 turns in a ring-shaped guide rail 14 with a ring-shaped passage 15 which connects to the open end of the double wall 2–3 of the drum. Said guide rail forms part of aforesaid wall 13. The drum 1 is driven around its circumference by a drive mechanism 16. The outer wall of the drum 1 is provided with several U-shaped guide rings 17 in which guide rolls 18 engage. The fixed wall 13 forms part of a chamber 19 in which the front part of tube 10 opens. The burner 20 is also installed in this chamber, the nozzle of which comes out into the front section of the drum 1 and which is intended for igniting the waste dumped in the drum.

The blower pipe of a blower 21 is connected to the chamber 19 the intake pipe of which connects to a duct 22 which opens into the loading area 23 of the installation. The incineration air is taken in via this duct and is sent via the ring-shaped passage 15 in the wall 13 and the front open end of the tube 10 in the drum for cooling the double wall 2-3 and for incinerating the waste. In order to allow this cooling to proceed in optimal fashion and to procure the good incineration of the gases a tube 24 is installed in the wall 13 through which recycled combustion gases are sent into the drum. To this end the tube is connected to a duct 25 with a fan 26, the end of which duct is connected to an extractor duct 27 which leads to the gas scrubbing installation. The latter duct is connected to an electrostatic filter 28 for cleaning the gases and which is in turn connected to a heat exchanger 29 which is connected to the flue 30 which has an opening 31 at the bottom for the removal of the incinerator slag. The rear end of the drum issues into this flue, which forms part of a brickwork chamber 32 built around the drum. The lower part of the heat exchanger 29 and of the electrostatic filter 28 is provided with an extractor duct 33 for removing fly ash resulting from incineration. Above a filler shaft 34 in the loading area 23 there is a travelling bridge with crab and grab for filling the filler shaft with waste. This filler shaft leads into drum 1 and is provided with a slider 35 actuated by a pressure cylinder for pushing the waste to be burnt into a drum.

When the burner 20 has preheated the inside of the drum 1 and the waste is dumped in the drum 1 via the filler shaft 34 and ignites, the drum 1 is made to rotate by means of the driving mechanism 16, so that the waste moves gradually to the rear of the drum and is adequately mixed by the radially installed double walls 11 of the drum. At the same time the incineration air supplied via the duct 22 will be blown through the double drum wall 2-3, the radially installed walls 11, and the central tube 10, and the recycled flue gas supplied through the duct 25, directly into the incineration zone of the drum, so that the walls of the drum are adequately cooled and the waste is prevented from baking onto the walls of the drum. Similarly the radially positioned walls 11 ensure that the combustion gases, the incineration air, and the recycled combustion gases are adequately mixed in the drum in order to obtain adequate incineration of the waste, the slag residues of which are removed via the opening 31 at the bottom of the flue 30. During the rotating motion of the drum 1 the spherical shutters 8 always fall downwards under their own weight, so that the openings 4 facing upwards are never closed and the openings 4 facing downwards are shut with the exception of the radial grooves 5 through which a small part of the incineration air can always escape. By this arrangement the gases flowing through the double walls 2-3, the radial walls 11, and the central tube 10 of drum 1 rise between the waste in order to procure optimal combustion.

It goes without saying that the form, dimensions, number and mutual position of the components described above may differ and that some of these parts may be replaced by others which serve the same purpose.

I claim:

1. An installation for the incineration of waste comprising:

(a) an incineration drum having an axis, said drum having radial double walls with openings in said walls, (b) means for axially rotating said drum, (c) means for guiding said drum during rotation, (d) a burner for heating air and combustion gases from waste in said drum to cause said waste to ignite, (e) a double wall disposed in said drum and having a rear end, said double wall being closed at said rear end and the interior wall of said double wall being provided with openings, (f) a hollow central tube provided with openings and having a front open end and a rear end and disposed in said drum, said rear end of said tube being closed, and (g) means interconnecting said tube and said double wall to provide a duct for blowing incineration air directly into said drum, and (h) a duct for at least partially recycling burnt combustion gases from said drum and returning said burnt gases to said drum to cool said double wall to control the furnace temperature and prevent waste from baking onto said drum.

2. An installation as defined in claim 1, wherein said openings include openings facing upward and openings facing downward, further including a valve disposed in each said opening to open said openings facing upward and at least partially close said openings facing downward during rotation of said drum.

3. An installation as defined in claim 2, wherein each said valve includes an opening with a conical seat and plural radial grooves around the perimeter thereof, further including a protective cap disposed remote from the exhaust side of said opening in said valve and a spherical shutter disposed above the inlet side of said opening in said valve and movable back and forth shutting said opening with the exception of said radial grooves.

4. An installation as defined in claim 1, further including a roller bearing disposed in a said wall, said double walls having a space therebetween with an open end, said front open end of said tube being mounted in said roller bearing and a ring shaped guide rail having a ring-shaped opening connected to said open end of said space between said double walls of the drum, said burner further including a blower pipe, said blower pipe of said burner protruding through said wall for igniting waste in said drum, said wall forming part of a chamber for receiving a duct for the supply of incineration air to the drum.

5. An installation as defined in claim 4, wherein said installation further includes a filler shaft having an outlet, the outlet of said filler shaft protruding through said wall and extending into said drum.

6. An installation as defined in claim 1, further including a heat exchanger, wherein said walls form a part of a chamber, further including a flue for said chamber, said flue disposed around said drum, the rear end of said drum communicating with said flue, said flue being connected to said heat exchanger and an electrostatic filter having an exhaust duct for carrying treated gas to a gas scrubbing installation, said exhaust duct connected to one end of a further duct, the other end of said further duct extending into said drum.

* * * * *